United States Patent [19]

Vermillion

[11] Patent Number: 4,662,913

[45] Date of Patent: May 5, 1987

[54] VACUUM CLEANER BAG SUSPENSION

[75] Inventor: Don W. Vermillion, Anderson, S.C.

[73] Assignee: The Singer Company, Stamford, Conn.

[21] Appl. No.: 868,505

[22] Filed: May 30, 1986

[51] Int. Cl.[4] ..... B01D 46/52

[52] U.S. Cl. ..... 55/357; 15/351; 55/369; 55/378; 55/380; 55/381; 55/DIG. 2; 55/DIG. 3

[58] Field of Search ..... 55/357, 369, 378, 380, 55/381, 370, 371, DIG. 2, DIG. 3; 15/350, 351

[56] References Cited

U.S. PATENT DOCUMENTS

| | | | |
|---|---|---|---|
| 1,787,914 | 1/1931 | McCarty | 55/369 |
| 1,953,189 | 4/1934 | Orr | 55/378 X |
| 2,259,855 | 10/1941 | Martinet | 55/378 X |
| 2,516,121 | 7/1950 | Howard | 55/381 |
| 2,599,520 | 6/1952 | Turner | 55/369 |
| 2,747,683 | 5/1956 | Ziegler, Jr. | 55/357 |
| 2,784,800 | 3/1957 | Segesman | 55/371 |
| 3,417,550 | 12/1968 | Fesco | 55/357 X |
| 4,311,493 | 1/1982 | Schaefer et al. | 55/369 |
| 4,342,575 | 8/1982 | Scott | 55/378 |
| 4,566,884 | 1/1986 | Jones et al. | 55/357 |

*Primary Examiner*—Kathleen J. Prunner
*Attorney, Agent, or Firm*—David L. Davis

[57] ABSTRACT

A resilient support sustaining the upper terminus of a dirt collecting bag on the handle of an upright vacuum cleaner in which an extensible strap on the bag is fastened within a downwardly open recess on the handle maintaining the upper terminus of the bag completely within the handle recess.

6 Claims, 5 Drawing Figures

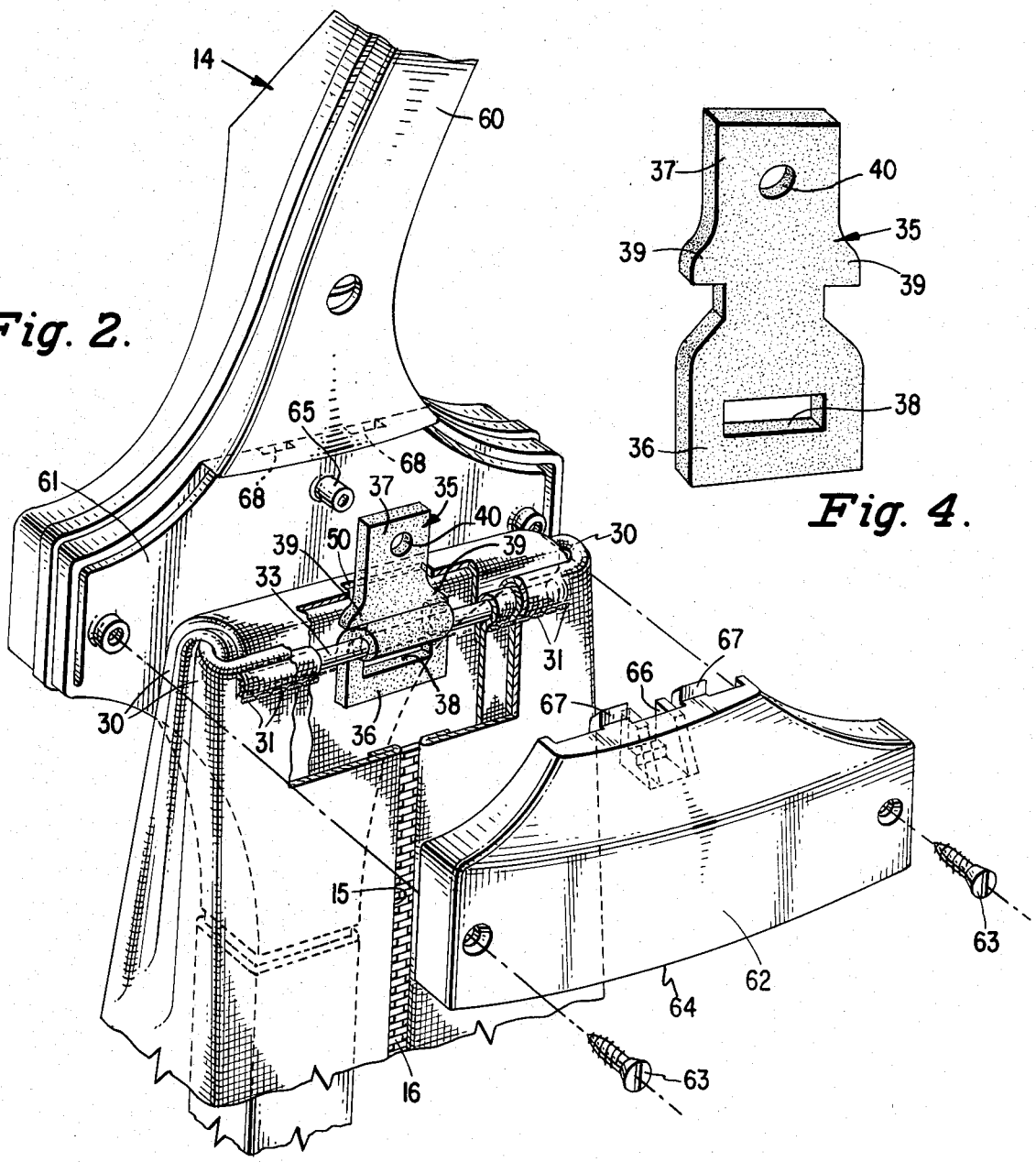
Fig. 2.
Fig. 4.
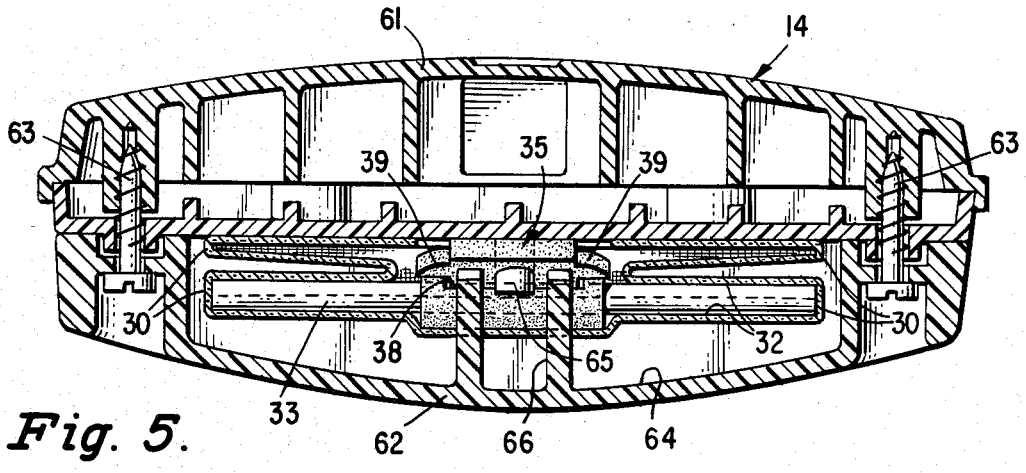
Fig. 5.

VACUUM CLEANER BAG SUSPENSION

BACKGROUND OF THE INVENTION

This invention relates to vacuum cleaners of the upright floor supported type and, more particularly, to a new and improved arrangement for suspending a fabric dirt collecting bag from the handle of an upright floor supported vacuum cleaner.

DESCRIPTION OF THE PRIOR ART

It is known to suspend a fabric dirt collecting bag from the handle of an upright vacuum cleaner by a connection element such as a coil spring, extendable cord, or the like, which is exposed to the exterior of the cleaner, as disclosed for example in U.S. Pat. No. 2,829,734, Apr. 8, 1958, of Brace. Such an exposed bag suspension arrangement not only detracts from the appearance of the cleaner, but is disadvantageous in that the exposed bag suspension elements are prone to become entangled with household objects such as tablecloths, drapes, electric cords, or the like, with consequent likelihood of injury not only to household objects but also to the bag suspension elements.

The U.S. Pat. No. 4,566,884, Jan. 28, 1986, of Jones et al. discloses a resilient bag suspension arrangement for an upright vacuum cleaner handle in which a coil spring provides resiliency to the bag support, and much of the bag supporting structure is arranged within the fabric bag and enclosed with a recessed cover. This patented construction, however, is bulky in size and relatively expensive.

SUMMARY OF THE INVENTION

It is an object of this invention to provide a cost effective arrangement for resiliently suspending a fabric dirt collecting bag from the handle of an upright vacuum cleaner in which the entire bag top as well as the bag supporting structure is hidden from view and protected from outside interference. This object of this invention is attained by securing on the top of the bag a resilient supporting element formed with an eyelet and providing on the vacuum cleaner handle a downwardly open recess accommodating the entire top of the bag with an eyelet engaging pin arranged within the recess together with means for preventing accidental disengagement of the eyelet from the pin.

DESCRIPTION OF THE DRAWINGS

With the above and additional objects and advantages in view, as will hereinafter appear, this invention will be described with reference to the accompanying drawings of a preferred embodiment in which:

FIG. 2 is an enlarged exploded perspective view of a portion of the handle of the vacuum cleaner shown in FIG. 1 together with the top of the fabric bag with portions broken away;

FIG. 4 is a perspective view of the resilient strap used in this invention to suspend the fabric bag from the vacuum cleaner handle; and FIG. 5 is a cross sectional view taken substantially along line 5—5 of FIG. 1.

DETAILED DESCRIPTION OF THE INVENTION

Figure 1:
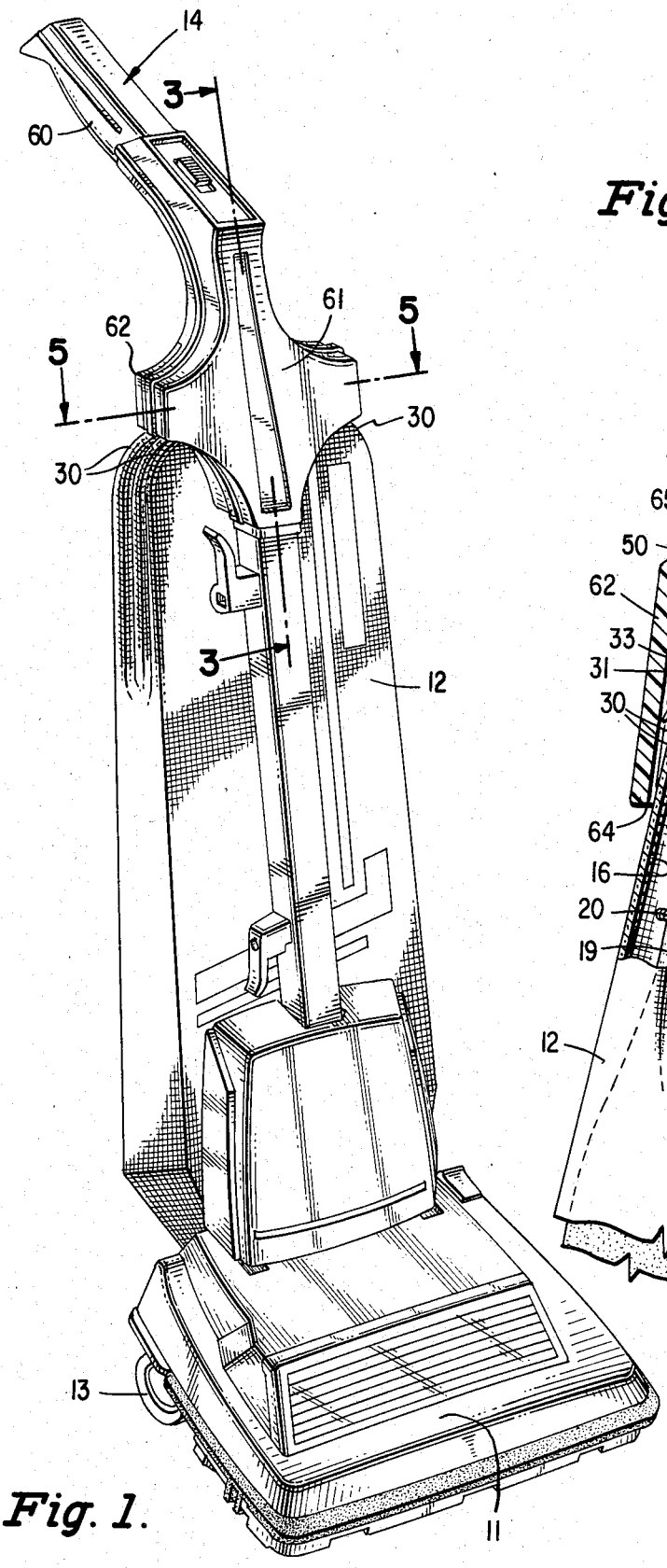
FIG. 1 is a perspective view of a floor supported upright vacuum cleaner having the dirt bag supporting arrangement of this invention applied thereto.

The dirt bag supporting arrangement of this invention may be applied to practically any floor supported upright vacuum cleaner. As illustrated in FIG. 1, such upright vacuum cleaners generally include a cleaning head 11 within which is housed a motor blower unit (not shown) for creating flow of air through a nozzle opening (not shown) beneath the cleaning head 11 and into a dirt collecting bag 12 connected at one end with the cleaning head. Typically, such upright vacuum cleaners include wheels 13 or equivalent swivels, rollers or the like on the cleaning head facilitating movement across a floor under operator influence exerted by way of a handle indicated generally at 14 pivotally connected to the cleaning head 11.

The dirt collecting bag 12 is conventionally a stitched fabric tube pleated at the sides and formed lengthwise with an opening 15 which may be closed by a zipper fastener 16. A flexible conduit 17 is usually provided within the fabric bag 12 to conduct dirt laden air from the motor blower unit in the cleaning head 11 upwardly through the dirt collecting bag to an adapter near the top of the bag onto which a disposable filter bag 19, usually made of paper or the like, may be secured as by a spring loop 20.

As illustrated in FIGS. 1 and 2, the fabric dirt collecting bag 12 at the top is formed with several pleats 30 at each side so that the bag narrows toward the upper terminus. The pleated top of the fabric bag is inverted so as to extend into the interior of the bag where, closely adjacent the upper terminus, the inverted bag segment is provided with two transversely extending parallel lines of stitches 31 extending transversely across the bag segment. The lines of stitches 31 form opposed pockets 32 in the pleats at each side of the inverted segment of the bag top, within which pockets a dowel 33 is constrained. In the space between the pleats 30 at each side of the inverted segment of the bag top the dowel 33 is exposed to the interior of the bag between the pockets 32 and, about this exposed portion of the dowel, a strip of resilient material 35 is secured.

The flexible conduit 17 for directing dirt laden air may also be supported within the fabric bag 12 near the top thereof as by stitching securing the conduit 17 to the inverted bag segment beneath the dowel pockets 32.

As shown in FIG. 4 the resilient material strip 35, which may be formed of synthetic rubber or the like, includes a wide extremity 36 and a narrow extremity 37. The wide extremity 36 is formed with a transverse slot 38 substantially as wide as the narrow extremity 37 and through which the narrow extremity 37 is passed to form a simple knot about the exposed portion of the dowel. The material strip 35 may be formed on each side with a projection 39 which, after being forced through the slot 38, deter loosening of the knot about the dowel.

After knotting the resilient strip about the dowel, the narrow extremity 37 of the strip is passed through a slit 50 in the fabric bag so as to extend externally above the top of the bag 12. A circular aperture 40 is formed in that portion of the narrow extremity of the resilient strip which is exposed above the top of the bag 12.

Figure 3:
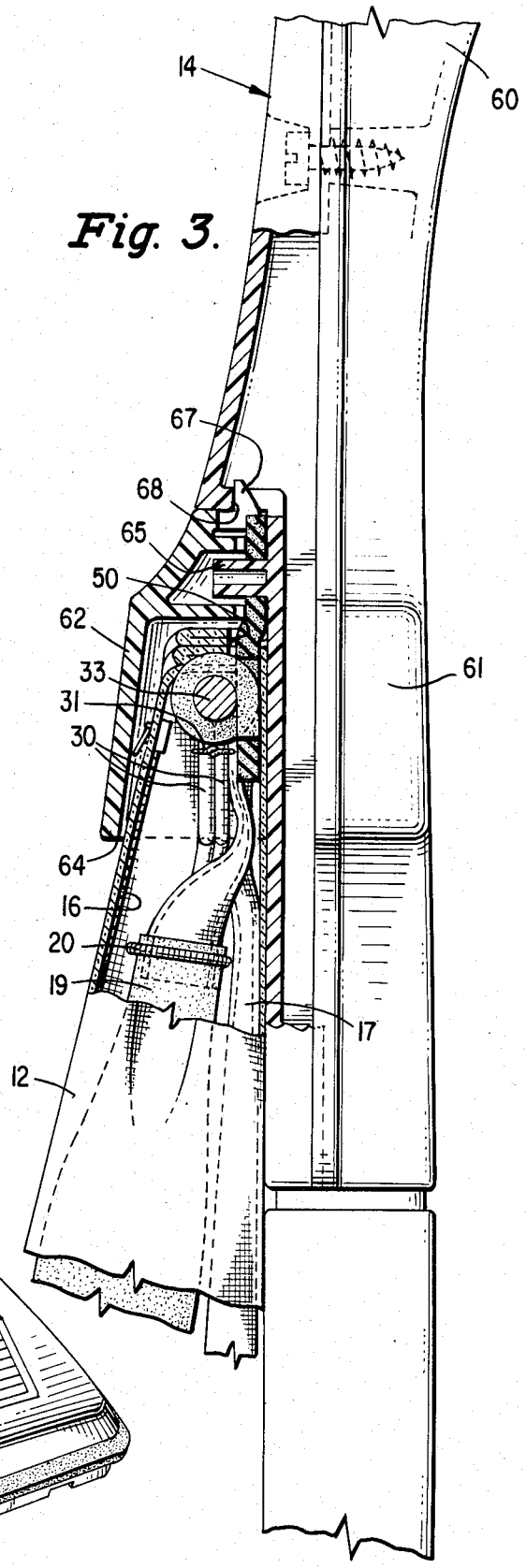
FIG. 3 is an enlarged cross sectional view taken substantially along line 3—3 of FIG. 1.

Referring particularly to FIGS. 2 and 3, the vacuum cleaner handle 14 adjacent a hand grip portion 60 at the upper extremity thereof is formed with a laterally enlarged segment 61 adapted to accommodate a similarly shaped cover 62 which, when secured to the handle segment 61 by screws 63, forms on the handle 12 a downwardly open recess 64. A pin 65 extending from the handle segment within the recess 64 is embraced at its free extremity within a cavity 66 formed on the interior of the cover 62. Lugs 67—67 formed on the cover 62 may be provided for engagement within notches 68—68 in the handle 14 to constrain the cavity 66 over the free extremity of the pin when the cover 62 is secured to the handle.

The aperture 40 in the narrow extremity 37 of the resilient strip 35 is constrained on the pin 65 by the cover cavity 66 thus resiliently supporting the top of the fabric bag 12 completely within the recess 64 in the handle 14. The dowel 33 not only provides for a particularly cost effective means for securing the resilient strip 35 to the fabric bag, but also aids in maintaining the shape of the bag top in conformity with that of the recess 64 so as not to impede free shift of the bag 12 as the weight of collected dirt increases within the bag.

Having set forth the nature of this invention and described a preferred embodiment thereof, what is claimed herein is:

1. An upright vacuum cleaner having a chassis movably supported on the floor, a handle pivotally attached thereto and extending upwardly therefrom, a bag extending from said chassis upwardly adjacent said handle to an upper terminus thereof, and means for detachably securing said bag to said handle comprising:

a resilient element secured to and extending upwardly from the upper terminus of said bag, means secured to and defining with said handle a downwardly open recess shaped to accommodate the upper terminus of said bag, and fastening means carried by said handle within said recess and engageable with said resilient element whereby said resilient element and the upper terminus of said bag are constrained within said downwardly open recess.

2. An upright vacuum cleaner as set forth in claim 1 in which said downwardly open recess is defined between a surface formed integrally on said handle and an arched cover plate secured against said surface.

3. An upright vacuum cleaner as set forth in claim 1 in which said resilient element comprises a strip of extensible material formed with an aperture in that portion extending upwardly from the upper terminus of said bag, and in which said fastening means includes a pin traversing said bag accommodating recess and extending through the aperture in said strip of extensible material.

4. An upright vacuum cleaner as set forth in claim 3 in which a dowel is constrained within said bag adjacent the upper terminus thereof, in which another portion of said strip of extensible material is formed with a slot, and in which said portion extending upwardly from the upper terminus of said bag is looped around said dowel and passed through said slot to knot said strip of extensible material to said dowel.

5. An upright vacuum cleaner as set forth in claim 1 in which a dowel is constrained within said bag adjacent the upper terminus thereof, and in which said resilient element comprises a strip of extensible material knotted to said dowel.

6. An upright vacuum cleaner having a floor supported chassis, a handle pivotally attached to said chassis and extending upwardly therefrom, a fabric bag extending from said chassis upwardly adjacent said handle to an upper terminus thereof, inwardly folded pleats formed in opposite sides of the upper terminus of said fabric bag, said pleats extending only partway transversely across said bag upper terminus to define a space between the opposing pleats, said pleated upper terminus of said bag being inverted to extend to the interior of said bag, and said pleats being secured by parallel lines of stitches extending transversely across said bag, said stitches defining laterally aligned pockets between contiguous pleats at each side of said bag, a dowel constrained in said laterally aligned pockets and including a central portion spanning the space between the opposing pleats, a resilient strip having a free extremity and formed at the opposite extremity with a lateral slot, said resilient strip being looped around the central portion of said dowel with said free extremity of the strip passing through said slot to knot said strip to said dowel, said bag being formed with a slit for accommodating passage of the free extremity of said strip to a position exteriorly of said bag and projecting upwardly from said bag upper terminus, means defining a downwardly open recess on said vacuum cleaner handle, and fastening means within said recess for engaging the free extremity of said resilient strip to retain the upper terminus of said bag within said recess.

* * * * *